US010364137B2

(12) United States Patent
Hollister

(10) Patent No.: US 10,364,137 B2
(45) Date of Patent: Jul. 30, 2019

(54) MULTI-CONTAINER REFRIGERATION, DISPENSING, AND MANAGEMENT UNIT

(71) Applicant: PenguinTap, Inc., Myrtle Beach, SC (US)

(72) Inventor: Randy Hollister, Pawleys Island, SC (US)

( * ) Notice: Subject to any disclaimer, the term of this patent is extended or adjusted under 35 U.S.C. 154(b) by 0 days.

(21) Appl. No.: 15/470,306

(22) Filed: Mar. 27, 2017

(65) Prior Publication Data

US 2017/0275146 A1 Sep. 28, 2017

Related U.S. Application Data

(60) Provisional application No. 62/313,951, filed on Mar. 28, 2016.

(51) Int. Cl.

| | |
|---|---|
| ***B67D 1/04*** | (2006.01) |
| ***B67D 1/00*** | (2006.01) |
| ***B67D 1/08*** | (2006.01) |
| ***B67D 1/12*** | (2006.01) |
| ***B67D 1/14*** | (2006.01) |

(52) U.S. Cl.

CPC ..... *B67D 1/0418* (2013.01); *B67D 1/0004* (2013.01); *B67D 1/0888* (2013.01); *B67D 1/1247* (2013.01); *B67D 1/1405* (2013.01)

(58) Field of Classification Search

CPC .. B67D 1/0004; B67D 1/0888; B67D 1/0418; B67D 1/1247

USPC ..... 222/129.1, 136, 144, 146.1, 146.6, 148, 222/230, 399

See application file for complete search history.

(56) References Cited

U.S. PATENT DOCUMENTS

| | | | | | |
|---|---|---|---|---|---|
| 2,085,274 | A * | 6/1937 | Rutt | B67D 1/04 | 137/208 |
| 2,345,840 | A * | 4/1944 | Strong | B67D 1/04 | 137/613 |
| 2,593,770 | A * | 4/1952 | Kollsman | B67D 1/0418 | 141/46 |
| 2,956,418 | A * | 10/1960 | McCann | F25D 31/002 | 165/132 |
| 3,180,529 | A * | 4/1965 | Buffington | F25D 11/00 | 222/131 |
| 3,195,779 | A * | 7/1965 | Nicko | B67D 1/04 | 222/129.1 |
| 4,143,793 | A * | 3/1979 | McMillin | B67D 1/04 | 222/1 |

(Continued)

*Primary Examiner* — Vishal Pancholi

(74) *Attorney, Agent, or Firm* — Douglas Kim Law Firm, LLC; Douglas W. Kim

(57) ABSTRACT

This invention is a refrigeration, dispensing, and management system for beverage and beverage containers that includes a tap attached to an upper door and a supply line; a recess base in a recess of a housing; a slide slidably carried by the recess base having a slot; a pressurized gas cylinder connected to the housing and attached to a gas line in fluid communications with the supply line wherein the gas cylinder contains gas selected from the group consisting of $O_2$, $CO_2$, $N_2$ or other inert gas; and, a cap placed on the beverage container so that when the tap is opened, pressurized gas enters the cap and the snorkel through an inlet defined in the cap, forces gas into the beverage container, and forces the beverage out of the outline defined in the cap, through the supply line and out of the tap.

18 Claims, 8 Drawing Sheets

(56) References Cited

U.S. PATENT DOCUMENTS

| | | | | |
|---|---|---|---|---|
| 9,073,741 | B2 | 7/2015 | Jannatkhah | |
| 9,193,577 | B2 | 11/2015 | McIntyre | |
| 2011/0108240 | A1* | 5/2011 | Bax | B67D 1/06<br>165/104.19 |
| 2013/0032564 | A1 | 2/2013 | Rosbach | |
| 2014/0262899 | A1 | 9/2014 | Mociak | |

* cited by examiner

MULTI-CONTAINER REFRIGERATION, DISPENSING, AND MANAGEMENT UNIT

BACKGROUND OF THE INVENTION

1) Field of the Invention

The present invention relates to an intelligent refrigeration unit designed to store and dispense beverages such as beer.

2) Description of Related Art

In modern times, the craft beers and microbreweries have become popular with consumers. With this movement the use of cans has rapidly increased. One study places the number of companies that are using cans to package their beverages at over 500. However, there is a movement to reduce the number of cans being produced and to reduce waste by supplying glass bottles that can be refilled from breweries. Commonly these glass bottles are called "growlers".

It is believed that in the 1800s, fresh beer was carried from local bars and pub to homes in a metal pail. These pails were pressurized by $CO_2$ and when the beverage sloshed in the pail, it created a "growling" sound as the liquid moved and $CO_2$ escaped from the pail. In modern times, a growler is glass bottle that can include rubber lined caps, ceramic tops with a O-ring or seal, or other lid designed to prolong freshness. While a growler will keep beer fresh for one to two weeks unopened, once a growler is opened, the beer will only stay fresh for about 36 hours before it goes flat.

When the growler is initially filled, there is a disadvantage in that air can be in the head space of the grower. Headspace is a volume of about 5% of the volume of the glass bottle where gas is disposed. Other glass bottle includes fill lines to prevent filling the growler to the top of the opening. Air in the headspace causes the beer to oxidation making the beer undesirable. Counter-pressure filling the headspace with $CO_2$ can reduce the chance of oxidation and has been shown to provide shelf lives of 4-6 weeks from unopened growlers. Some beers stored in 32-ounce swing-top growlers under cold, dark refrigeration have lived upward of 3-6 months without trace of oxidation making the present invention advantageous.

In response to the popularity of the craft beer, brewpubs, and microbreweries, growler filling stations have been opened such as the device shown in U.S. Pat. No. 9,073,741 which discloses, generally, a system for dispensing beverages, including, beer into containers, glasses, growlers, and the like. One such bottle is shown in United States Application Publication 20130032564 that discloses thermal metal containers principally for use in the purchase of beer from a brewery or pub off of a tap.

In the industry, there is a need to provide for a growler that can allow the storage of the beverage (e.g. beer) for a lengthy period of time much past the 24-36 hours currently possible. While the pressurized growler substantially lengthens the storage time, once the growler is taken home and opened the benefits of the pressurized system are lost. An attempt to lengthen the time that the beer stays fresh has been attempted through recharging caps such as United States Patent Application 2014/0262899, however, the cap needs to be used each time the growler is opened. Another attempt to preserve freshness is shown in U.S. Pat. No. 9,193,577.

However, a problem for which much attention should be spent is how to keep a growler's contents fresh, refrigerate the growler, dispense the contents, and allow for multiple growlers to be stored, preserved, refrigerated, and dispensed from a single unit.

Additionally, there is an inconvenience with growlers stored at home in that when leaving work or other location and returning home, the amount of a beverage in a growler is not known without physically being home. There for it would be advantageous to have a way to retrieve the volume and type of beverage in a growler from a remote location. It would also be advantageous to be able to collect, store and retrieve information related to the contents of a growler, the length of time between re-fills, the temperature of the beverage, the number of pours from a single growler and other such statistic information. Such information would also be advantageous to be aggregated for statistical analysis for vendors, user and the like.

Accordingly, it is an object of the present invention to provide for a storage and dispending unit that preserves the contents of a growler as well as keeps the content refrigerated.

It is another object of the present invention to provide a multi growler unit.

It is another object of the present invention to provide a data collection, storage and reporting unit to collect, store and report data related to the storage and dispensing of a beverage from a growler.

SUMMARY OF THE INVENTION

The above objectives are accomplished according to the present invention by providing a refrigeration, dispensing, and management system for beverage and beverage containers comprising: a housing connected to a power source; a upper door and lower door for covering a recess; a tap attached to the upper door and a supply line; a recess base disposed in the recess wherein the supply line provides fluid communications between the recess base and the tap and having a support; a slide slidably carried by the recess base having a slot; a pressurized gas cylinder connected to the housing and attached to a gas line in fluid communications with the supply line wherein the gas cylinder contains gas selected from the group consisting of $O_2$, $CO_2$, $N_2$, or other inert gas; and, a cap removable received in the slot having a snorkel that can be inserted into the beverage container so that when the cap is placed on the beverage container and the tap is opened, pressurized gas enters the cap and the snorkel through an inlet defined in the cap, forces gas into the beverage container, and forces the beverage out of the outline defined in the cap, through the supply line and out of the tap.

The system can include a controller in communications with a personal computer and remote server; the controller having communications between at last one of actuators, display, strain gauge, temperature sensor, humidity sensor, gas sensor, door sensor, flow meter, or any combination thereof for receiving information from the various sensors; transmitting the information to the portable computer device or remote server through wired or wireless connection; and, receiving instructions from the remote server, remove computer or personal computer device to perform functions such as displaying a message on the housing display, modifying the temperature of the recess through use of the refrigeration element, or lock the door in a closed position.

The system can aggregate the data collected from multiple controllers for market research, user information, and the like. The system can include a cap that includes various valve to prevent backflow during the operation of the invention.

In one embodiment, the invention is a dispensing unit for beverages having a housing having an air-conditioned compartment and a utility compartment; a refrigeration assembly disposed in the utility compartment accessible through a utility compartment door for cooling the air-conditioned compartment in the housing; a pressurized gas container removably disposed in the utility compartment and removably connected to a gas manifold to deliver pressured gas to the manifold; a gas regulator disposed between the pressurized gas container and the manifold to control the amount of pressure delivered to the manifold from the pressurized gas container; a one-way valve disposed between the pressurized gas container and the manifold to prevent fluid from flowing from the manifold to the pressurized gas cylinder; a purge assembly carried by the housing and in fluid communication with the manifold; a removable cap removably attached to the purge assembly and removably attached to a beverage container, the removable cap having an inlet and an outlet; a purge actuator included in the purge assembly that, when actuated, opens a purge valve disposed between the manifold and the removable cap so that a predetermined amount of pressurized gas from the pressurized gas container enters the beverage container through the removable cap so that pressurized gas from the purge assembly can be injected into the container to displace the existing gas in the headspace; a container tray disposed in the air-conditioned compartment having a connection block removably connected to the removable cap and in fluid communications with the manifold so that the contents of the beverage container are pressurized; a tap attached to the housing and in fluid communications with the fluid in the beverage container so that when the tap is actuated, fluid in the beverage container is dispensed through the tap; a control unit carried by the housing connected to a display; a scale carried by the container tray and connected to the control unit to determine the weight of the beverage container and the fluid in the beverage container; a temperature sensor disposed in the air-conditioned compartment and connected to the control unit to determine the temperature in the air-conditioned compartment; a pressure sensor in fluid communications with the manifold for determining the pressure in the pressurized gas container and in communications with the control unit; a set of computer readable instructions included in the control unit that, when executed by a processor, receiving beverage container information from an input assembly carried by the housing and connected to the control unit, receiving weight information from the scale, approximating the volume of fluid remaining in the container according to the beverage container information weight information, receiving the temperature from the temperature sensor, activating the refrigeration assembly when the temperature exceeds a pre-set temperature and deactivating the refrigeration assembly when the temperature falls below the pre-set temperature, receiving pressure information from the pressure sensor, displaying at least a portion of the beverage container information, approximate fluid remaining in the beverage container and temperature on the display, accessing an external database, retrieving additional beverage container information and displaying at least a portion of the additional beverage container information on the display, receiving purchase information from an external server and displaying purchase information on the display; and, a transceiver included in the control unit for transmitting the approximate fluid remaining in the beverage container, temperature in the air-conditioned compartment, pressure of the pressurized gas container, purchase information, at least a portion of the beverage container information and additional beverage container information to the remote computer device and transmitting the beverage container information and approximate fluid remaining in the beverage container to an aggregation database.

The invention can include an external pressurized gas connection so that an external source of pressurized gas can be attached to the manifold. The inlet and the outlet of the removable cap can include quick connects that are activated by a purge release lever included in the purge assembly to release the removable cap from the purge assembly and are activated by a connection block release lever carried by the connection block to release the removable cap from the connection block. A short snorkel can be attached to the removable cap so that when the beverage container is inverted when disposed in the air-conditioned compartment, sediment is collected around the removable cap. A purge snorkel can be attached to the removable cap so that pressurized gas from the pressurized gas container enters the beverage container through the removable cap so that pressurized gas from the purge assembly is deposited in the bottom half of the beverage container. A slot can be defined in the container tray for receiving the removable cap when the inverter container is placed on the container tray. A second removable cap can be removably attached to a second beverage container and in fluid communications with the manifold so that pressurized gas can enter the second beverage container forcing fluid from the second beverage container through a second tap so that fluid from the second container disposed on the air-conditional compartment can be dispensed externally from the housing. The set of computer readable instructions can include instructions for transmitting warnings to the remote computer device when the approximate fluid remaining in the beverage container falls below a pre-determined amount.

In one embodiment, a third removable cap can be removably attached to a third beverage container and in fluid communications with the manifold so that pressurized gas can enter the third beverage container forcing fluid from the third beverage container through a third tap so that fluid from the third container disposed on the air-conditional compartment can be dispensed externally from the housing. The invention can be configured for multiple beverage containers.

In one embodiment, the invention can include a dispensing unit for beverages comprising: a housing; a refrigeration assembly disposed for cooling a compartment defined in the housing; a pressurized gas container removably connected to a gas manifold to deliver pressured gas to the manifold; a purge assembly carried by the housing and in fluid communications with the pressurized gas container; a removable cap removably attached to the purge assembly and removably attached to a beverage container, the removable cap having an inlet and an outlet; a purge actuator included in the purge assembly that, when actuated, injects pressurized gas from the pressurized gas container into the beverage container through the removable cap so that pressurized gas from the purge assembly can be injected into the container to displace the existing gas in the headspace; and, a tap attached to the housing and in fluid communications with the fluid in the beverage container so that when the tap is actuated, fluid in the beverage container is dispensed through the tap.

A scale or weight sensor can be carried by the housing to measure the weight of the beverage container and the fluid in the beverage container; a control unit can be attached to the scale for approximating the volume of fluid in the container according to the weight of the container and the fluid in the beverage container; and, a display can be connected to the control unit and carried by the housing for displaying the approximate volume of fluid in the beverage container. A transceiver can be included in the control unit for transmitting the approximate volume of fluid to a remote computer device.

The invention can include a dispensing unit for beverages comprising: a housing having a refrigeration assembly for air-conditioning an internal compartment defined in the housing; a pressurized gas container; a purge assembly carried by the housing and in fluid communication with the pressurized gas container; a removable cap removably attached to the purge assembly and removably attached to a beverage container so that pressurized gas enters the beverage container to displace the existing gas in the headspace when the removable cap is attached to the purge assembly; and, a tap attached to the housing so that fluid in the beverage container is dispensed through the tap when the removable cap is in fluid communications with the tap and the tap is actuated.

A container tray disposed in the housing can support the beverage container and removable cap when the removable cap is in fluid communication with the tap; a scale can be carried by the container tray to determine the weight of the beverage container and the fluid in the beverage container; a control unit carried by the housing and connected to the scale; a set of computer readable instruction can included in the control unit for receiving the weight of the beverage container and the fluid in the beverage container, receiving beverage container information and approximating the volume of fluid remaining in the beverage container according to the weight and beverage container information and displaying the approximate volume of fluid remaining in the beverage container on a display connected to the control unit. The pressurized gas container can have a volume in the range of 70 grams to 120 grams; and, the beverage container can be a growler. The beverage container can have a volume in the range of 25 ounces to 80 ounces.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

Figure 1A:
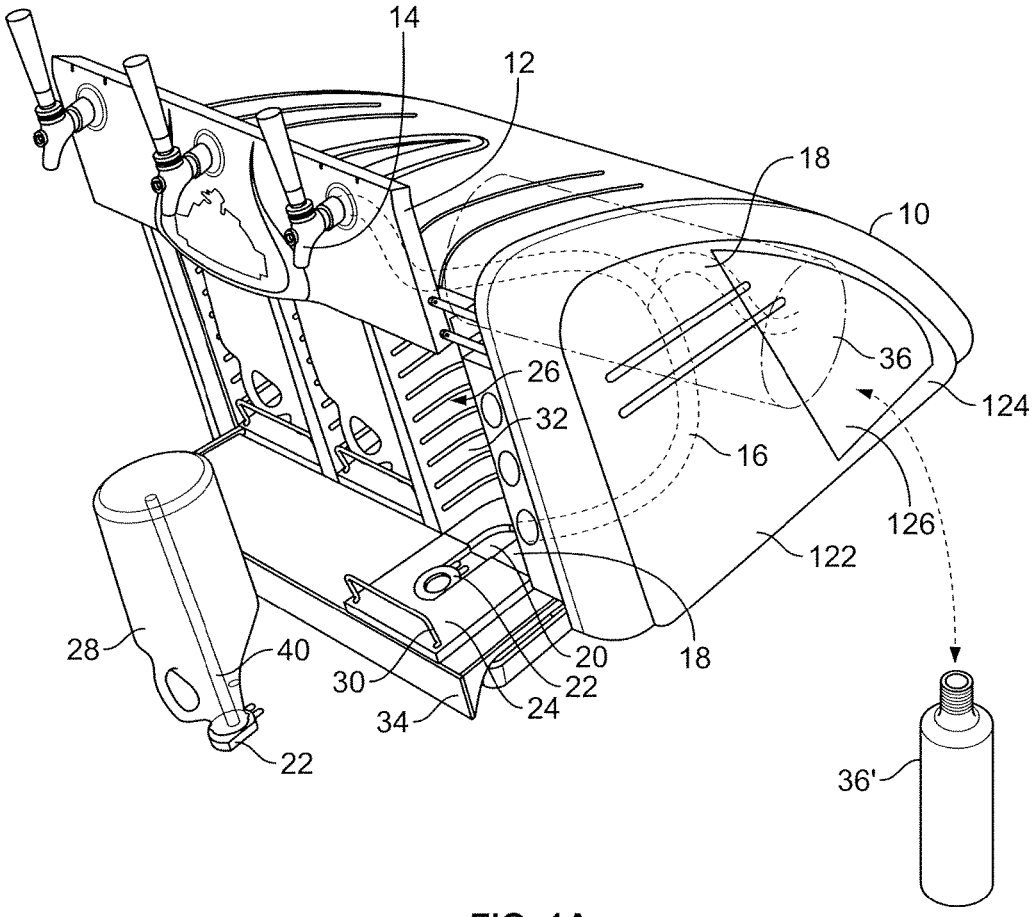
FIGS. 1A and 1B shows a perspective view of aspects of the invention.

It will be understood by those skilled in the art that one or more aspects of this invention can meet certain objectives, while one or more other aspects can meet certain other objectives. Each objective may not apply equally, in all its respects, to every aspect of this invention. As such, the preceding objects can be viewed in the alternative with respect to any one aspect of this invention. These and other objects and features of the invention will become more fully apparent when the following detailed description is read in conjunction with the accompanying figures and examples. However, it is to be understood that both the foregoing summary of the invention and the following detailed description are of a preferred embodiment and not restrictive of the invention or other alternate embodiments of the invention. In particular, while the invention is described herein with reference to a number of specific embodiments, it will be appreciated that the description is illustrative of the invention and is not constructed as limiting of the invention. Various modifications and applications may occur to those who are skilled in the art, without departing from the spirit and the scope of the invention, as described by the appended claims. Likewise, other objects, features, benefits and advantages of the present invention will be apparent from this summary and certain embodiments described below, and will be readily apparent to those skilled in the art. Such objects, features, benefits and advantages will be apparent from the above in conjunction with the accompanying examples, data, figures and all reasonable inferences to be drawn therefrom, alone or with consideration of the references incorporated herein.

DETAILED DESCRIPTION OF A PREFERRED EMBODIMENT

With reference to the drawings, the invention will now be described in more detail. Unless defined otherwise, all technical and scientific terms used herein have the same meaning as commonly understood to one of ordinary skill in the art to which the presently disclosed subject matter belongs. Although any methods, devices, and materials similar or equivalent to those described herein can be used in the practice or testing of the presently disclosed subject matter, representative methods, devices, and materials are herein described.

Unless specifically stated, terms and phrases used in this document, and variations thereof, unless otherwise expressly stated, should be construed as open ended as opposed to limiting. Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise.

Furthermore, although items, elements or components of the disclosure may be described or claimed in the singular, the plural is contemplated to be within the scope thereof unless limitation to the singular is explicitly stated. The presence of broadening words and phrases such as "one or more," "at least," "but not limited to" or other like phrases in some instances shall not be read to mean that the narrower case is intended or required in instances where such broadening phrases may be absent.

Figure 1B:
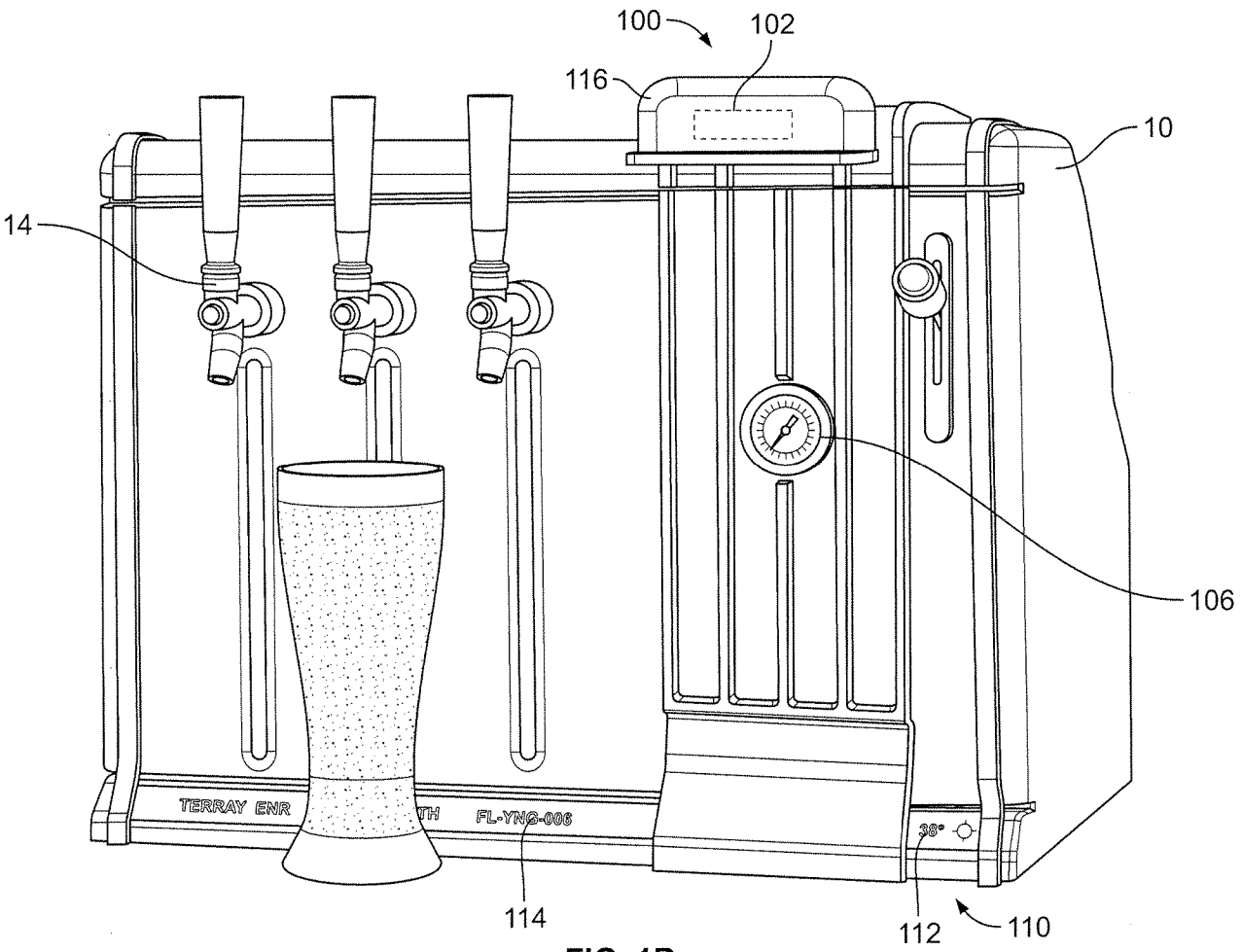

Referring to FIGS. 1A and 1B, a housing 10 includes a power source or can be connected to a power source such as traditional electrical outlet. The housing can include an upper door 12 that can have tap 14 attached. A supply line 16 can provide fluid communications between the tap and a recess base 18. The recess base can include a slot 20 defined in the bottom of the recess base for receiving a growler cap 22. A tray 24 can be received into the recess 26 and be generally disposed along the bottom of the recess. In an open position, a beverage container 28, such as a growler, can be placed on the tray with the tray pulled out of the recess. A support 30 can be used to both support the growler in a upright position as well as serve as a handle to pull and push the tray in and out of the recess.

The recess can include a refrigeration assembly 33 that can chill the air space in the recess thereby chilling the growler and its contents. In one embodiment, the housing include multiple recesses each able to store a growler. Each recess can include a refrigeration element can be set to different temperatures. In one embodiment, the refrigeration element can be a left or right recess and the temperature of the adjacent recesses is controlled through radiation of the chilled air from the refrigeration element. In one embodiment, the housing can include an air-conditioned compartment for receiving and storing growlers and a utility compartment for containing the refrigeration assembly and pressurized gas container. In one embodiment, the refrigeration assembly utilizing thermoelectric cooling to create a heat flux between. The refrigeration assembly can include one or more thermoelectric coolers, vapor cooler, magnetic, other refrigeration methods or any combination.

In one embodiment, the tray can be slideably or removably attached to a lower door 34 that can be opened allowing the tray to be removed from the recess for growler replacement and raised when the tray is placed in the recess.

A pressurized gas container 36 can be included in the housing and in fluid communication with supply line 16 through gas line 38 and can be connected to a manifold. Gas can include $CO_2$, $N_2$, or other inert gas so that the gas can be forced into the growler to remove air thereby reducing or eliminating the $O_2$ reaction with the beverage in the growler to preserve freshness. In one embodiment, the removable cap include a purge snorkel 40 allowing gas to be forced into the "bottom" of the growler when the growler is inverted thereby forcing fluid out of the growler into the removable cap and ultimately out of the tap. In one embodiment, the pressurized gas can be supplied by disposable $CO_2$ bullet-style cartridges, such as, for example, 70 to 120 gram bullet-style $CO_2$ containers 36'. In one embodiment, the housing can include an air-conditioned compartment 122 for receiving and storing one or more beverage containers and utility compartment 124 for containing the refrigeration assembly, pressurized gas container, power source, and the like. The utility compartment can be access through utility door 126.

The disposable bullet-style canister can add simplicity to the user both in use and when changing the canister. The bullet-style canister can also allow tracking of the number of times that the canister is replaced in a given period of time to indicate use and inventory. In one embodiment, the controller can measure the number of replacements can automatically place orders for canisters to replenish the supply of $CO_2$ cartridges according to use. There can also be an optional connector for larger refillable canister in one embodiment. The refillable canister can be internal or external to the housing.

Referring to FIG. 1B, the housing is shown in one configuration including a purge assembly 100. The purge assembly can be in fluid communication with the pressured gas container or manifold that is connected to an external pressurized gas source so that pressurized gas can be delivered to the purge assemble. A removable cap 22 is secured to the beverage container. The removable cap includes an inlet and an outlet. The removable cap is attached to the purge assemble in an upright position and at attachment block 102. The attachment block has a gas line in fluid communications to the pressurized gas, external pressurized gas source, or manifold so that gas can be injected into the removable cap and therefore into the beverage container when a purge actuator 104 is actuated. The gas enters the beverage container or growler and forces gas into the lower half of the container. The existing gas in the beverage container, that in the headspace, is displaced and exits the beverage container in the form of gas and/or foam. A housing pressure gauge 106 can be included and in fluid communications with the pressurized gas container to display the current pressure on the pressurized gas container or pressurized gas source.

The housing can include a display 110 than can be connected to a control unit and display the temperature 112 of the compartment containing the beverage containers and beverage container information 114 such as the name or brand of the fluid in the beverage container associated with one or more taps.

Figure 1C:
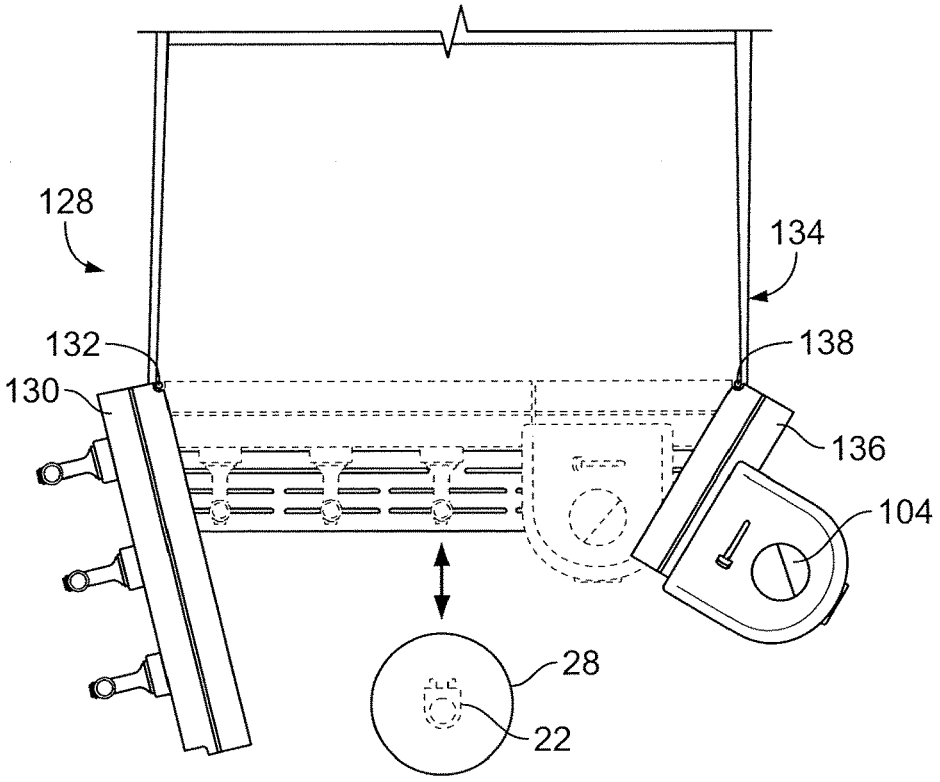
FIG. 1C shows a top view of aspects of the present invention.

Referring to FIG. 1C, an air-conditioned compartment 128 can be accessed by an air-conditioned compartment door. In one embodiment, the air-conditioned compartment door 130 can be attached to the housing a hinge 132 allowing the door to swing open forward of the housing so that the beverage container 28 with the removable cap 22 can be inserted and removed from the air-conditioned compartment. The door can include the taps so that the taps can be accessed when the door is open, along with the fluid lines, for cleaning or other maintenance. A utility compartment 134 can be included in the housing and accessed through utility door 136 that can be attached a utility door hinge 138 allowing the door to swing forward. When the utility door is opened, the various components including the refrigeration assembly, pressurized gas container, manifold, fluid lines, control unit, and the like can be accesses for cleaning, repair or other maintenance. The purge assembly actuator 104 can be disposed on the purge assembly.

Figure 1D:
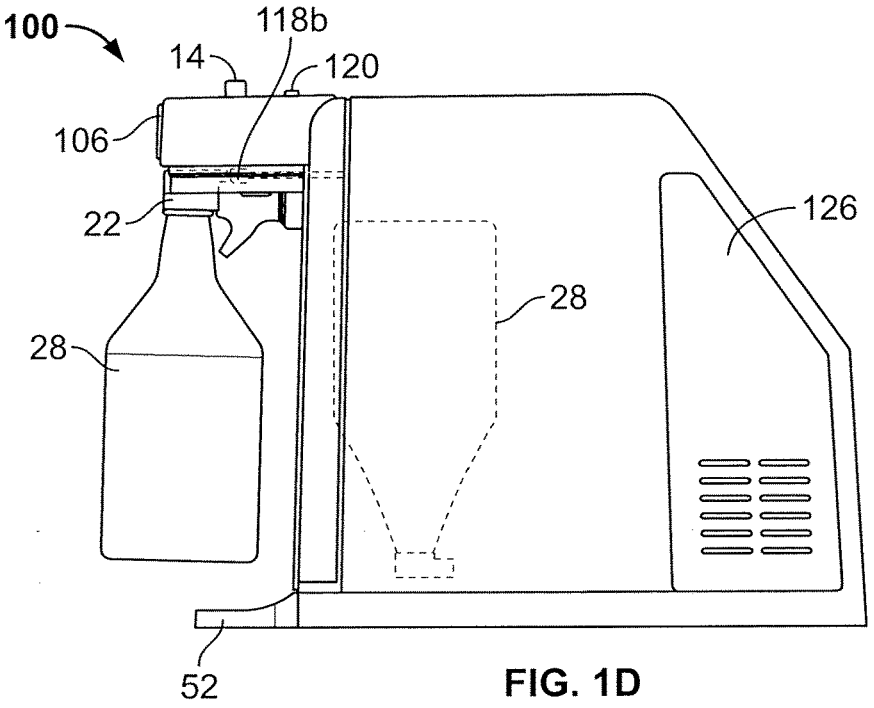
FIG. 1D shows a side view of the present invention.

Referring to FIG. 1D, the beverage container 28 is shown attached to the purge assembly 100 so that the removable cap 22 is attached to connectors (118*b* shown) of the purge assembly. When purge release lever 120 is actuated, the removable cap can be attached to and released from the connectors. Excess fluid that can escape the removable cap or connectors can be collected on the drain tray 52. After the beverage container has been attached to the purge assembly and the pressurized gas used to displace the pre-existing gas in the headspace, the beverage container can be placed in the housing and attached to the tap 14.

Figure 2A:
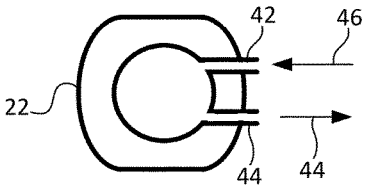
FIGS. 2A, 2B, and 2C show schematics of aspects of the invention.

Referring to FIG. 2A, the removable cap and one snorkel and their operation is shown in more detail. The removable cap, which can be affixed to the top of a beverage container can include a seal such as an O-ring, or compression seal or the like and can include an inlet 42 and outlet 44. When the removable cap is attached to the beverage container and the purge assembly, gas is inserted into the inlet and the pre-existing gas in the headspace is displaced and exits through the outlet. When the removable cap is in fluid communications with the tap and the tap is opened, a valve opens allowing gas from the pressurized gas container to flow into the cap in a direction shown as 46. The pressure in the growler then forces the beverage out of the outlet in a direction shown as 48. The inlet and outlet are in fluid communications with the recess base and therefore the gas line and the supply line so that the beverage in the growler is forced through the supply line out of the tap.

Figure 2B:
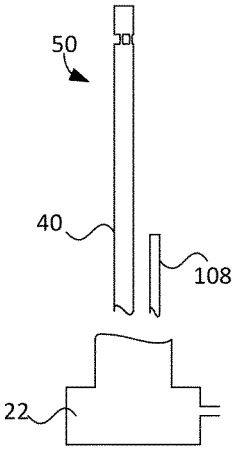

Referring to FIG. 2B, in one embodiment, the purge snorkel can include a dispenser head 50 which prevents the gas from impacting the wall of the growler and reduces the creation of foam. The purge snorkel can be removably attached to the removable cap to accommodate different beverage containers with different depths. For example, a 32 ounce growler would need a shorter purge snorkel than a 64 ounce beverage container. In one embodiment, a short snorkel can be attached to the removable cap so that when the beverage container is inverted and field in the beverage container is disposed, sediment that may have existed in the beverage container collects around the removable cap and is not forced out of the removable cap. This prevents the sediment from being dispensed into a glass or other receiving container.

Figure 2C:
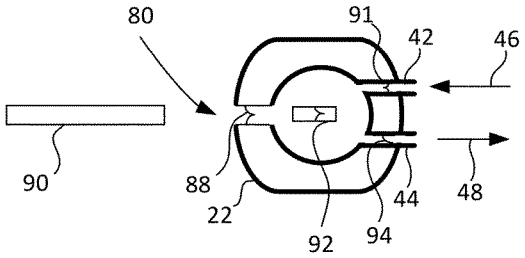

Referring to one embodiment of the removable cap in FIG. 2C, the cap can include a headspace gas opening 86 that has a valve 88 allowing gas to be injected into the bottle and blasting out the air in the headspace. When a blast nozzle 90 is inserted into the headspace gas opening, the valve is opened and the pressurized gas forces the air out of the outlet 44 in direction 48. A outlet valve 92 is closed with sufficient force to prevent the valve from opening unless the pressure within the growler reaches a predetermined level thereby opening the valve such as when dispensing the beverage. In one embodiment, a slot 94 or other opening is included in the cap which opening mechanically when the blast nozzle is inserted into the headspace gas opening allowing the gas air in the head space to escape through the slot. In one embodiment, the inlet includes a valve 91 that allow gas to be inserted into the growler, but prevent gas or fluid from exiting the growler through the inlet.

Figure 3A:
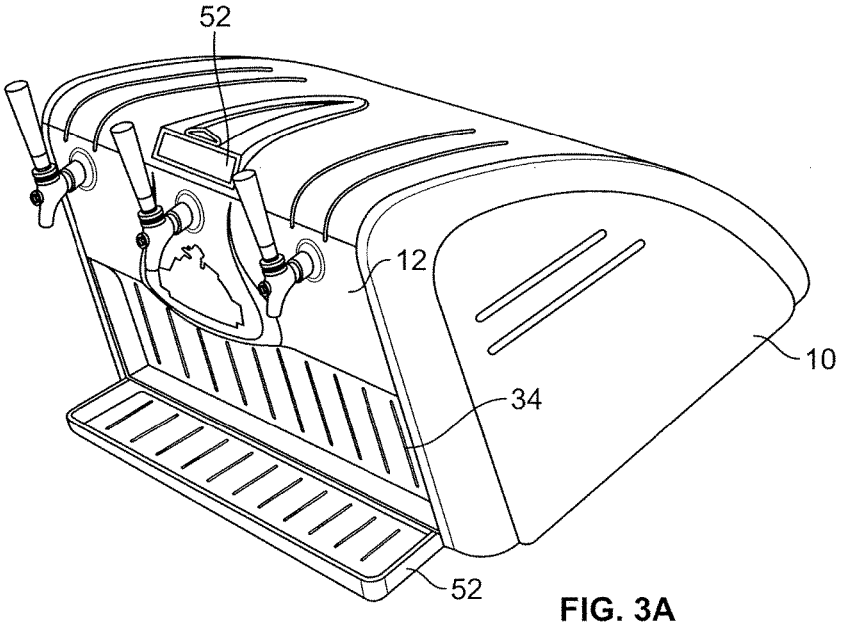
FIG. 3A shows a perspective view of aspects of the invention.

Referring to FIG. 3A, the upper door and lower door are shown in the closed position. Drain tray 52 is disposed under the taps to support a drinking container such as a glass or mug as well as to catch excess fluid that drips or otherwise does not arrive into the glass or mug. A display 54 can be included on the housing to provide various information to a user. The display can be electronically connected to a controller for sending and receiving display information. The drain tray can be in fluid communication with an internal compartment so that any excess or leaked fluid from the beverage container or tray can be collected in the drain tray. The purge assembly can be configured and carried by the housing so that any foam resulting from the injection of pressurized gas, displacement of pre-existing gas in the headspace, and resulting foam can be captured by the drain tray. The drain tray can be removed from the housing and emptied or cleaned as needed.

Figure 3B:
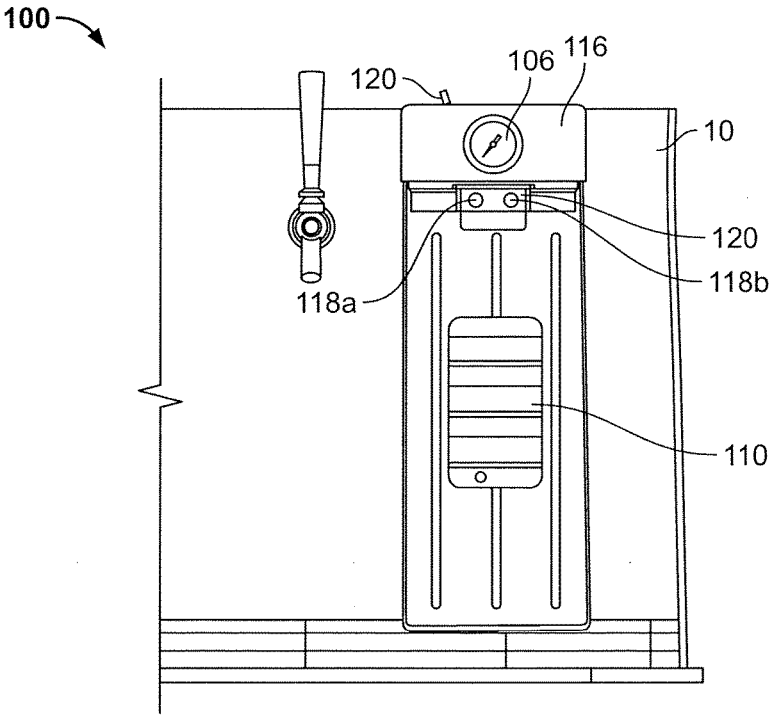
FIG. 3B shows a front view of aspects of the present invention.

Referring to FIG. 3B, the housing 10 is shown with purge assembly 106 attached to the housing. Pressure gauge 106 can be disposed on the purge assembly upper structure 116 that extends forward and away from the front of the housing to allow the beverage container and the removable cap to be attached to connectors 118*a* and 118*b* that corresponding to the inlet and outlet of the removable cap. The connectors can be a quick release connector and can be simultaneously released with purge release level 120. Display 110 can be carried by the housing and be a touch screen to allow for varying the display information. The display can also be used as an input to allow the control unit to receive information such as beverage container information that can include manual entry of the fluid in the beverage container, the beverage container size, time, and date the beverage container was placed on the housing and the like. The purge assembly can include a purge connector block 122 that can carry the connectors 118*a* and 118*b* to assist with alignment of the removable cap inlet and outlet with the connectors. One connector can be in fluid communications with the pressurized gas container or manifold and the other connector can allow gas to escape that is displaced from the headspace of the beverage container or allow foam to exit the removable cap.

Figure 4:
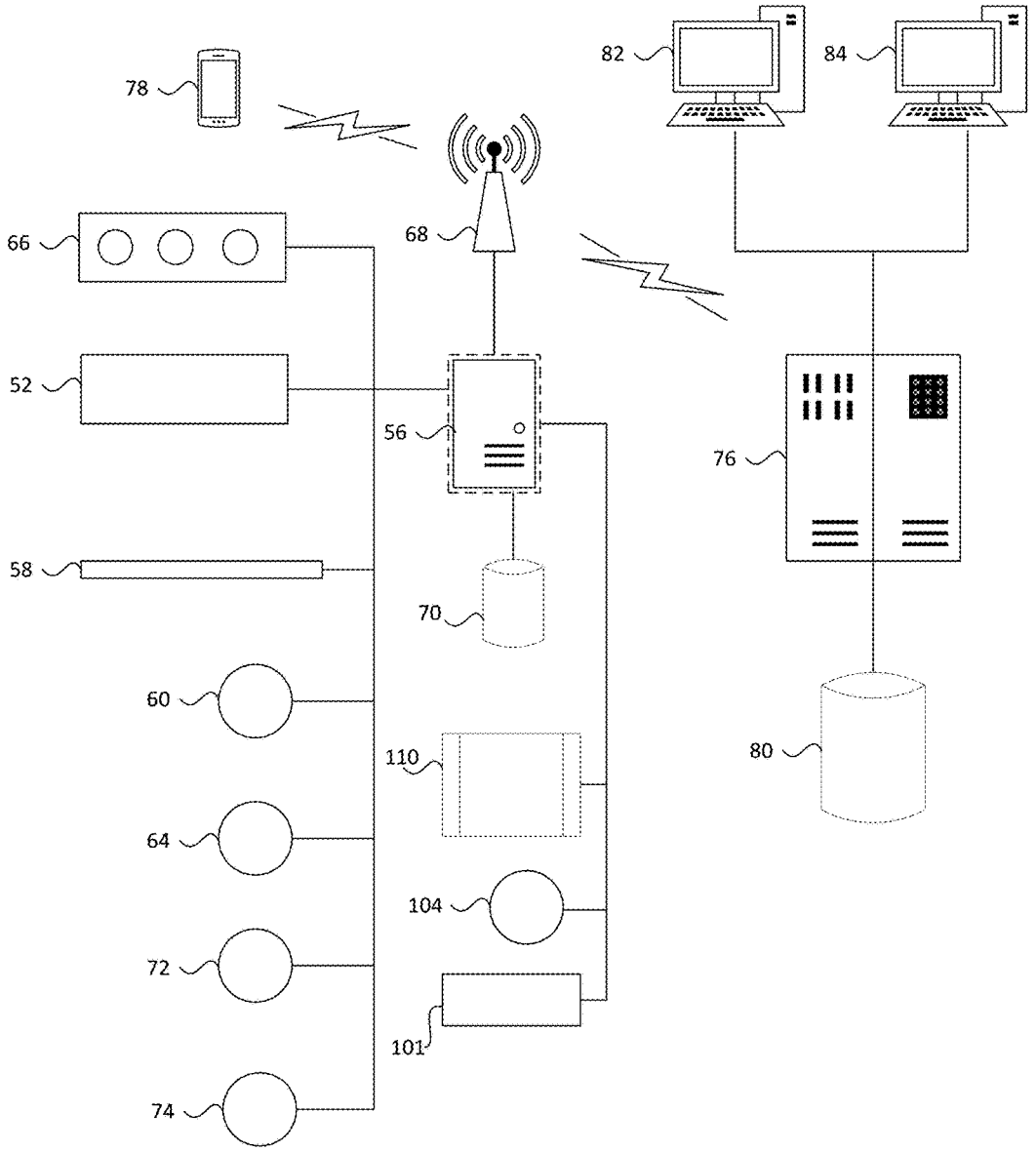
FIG. 4 shown a schematic of aspects of the invention.

Referring to FIG. 4, the communications and operations of the invention are shown in more detail. A controller unit 56 is included in the housing and can be connected to the display. A strain gauge, scale, or other weight measuring device 58 can be in the recess to measure the weight of the beverage container and the fluid in the beverage container. In operation, the weight of certain fluids is generally known. For example, beer generally weights in the range of 8.4 pounds per gallon (light lager) to 8.7 pounds per gallon (barley wine). Therefore, a pint would weigh between 1.05 pounds to 1.8 pounds. By knowing the starting weights prior to dispensing fluid from the beverage container, and the ending weight after dispensing fluid from the beverage container, the volume of fluid removed from the container can be approximated. Therefore, the amount of fluid remaining in the beverage container can be known and displayed to the user.

A temperature sensor 60, humidity sensor 62, and gas sensor 64 can be attached to the controller and disposed in the recess to record environmental conditions within the compartment that receives the beverage containers. The temperature of the recess can be controlled by refrigeration member actuator 66 which can control the refrigeration member. The control unit can received a pre-set temperature setting representing the desired temperature of the beverage container contents. The control unit can activate the refrigeration assembly when the temperature exceeds the pre-set temperature and deactivating the refrigeration assembly when the temperature falls below the pre-set temperature.

The control unit can also include an input allowing information, such as beverage container, growler, or fluid to be entered into the control unit and stored in writable memory 70. For example, the user can insert a growler then input the type of beverage in the growler, the type and/or size of growler, the location where the growler was filled, and other information concerning the growler and its contents. The control unit can determine when the beverage container plus the fluid is changing as fluid is dispensed from the beverage container. By recording the starting weight and the ending weight, the control unit can approximate the amount of fluid dispensed as well as the amount of fluid remaining in the beverage container. When the housing doors are opened, a door sensor 72 can record the number of open and close cycles as well as the time the door was left open. A flow meter 74 can be included in line with the supply line to measure the amount of beverage that is dispensed from the growler.

In one embodiment, the purge actuator 104 is connected to the control unit. When the purge actuator is actuated, the control unit receives information from the actuator and responds by opening a purge valve for a predetermined period of time to allow gas to flow into the removable cap attached to the purge assembly. By having the control unit open the valve for a predetermined period of time, the beverage container does not received excessive pressurized gas to displace the existing gas in the headspace and foam produce resulting from this process is reduced. Additionally, by metering the amount of pressurized gas that enters the beverage container, over-pressurizing is avoided, and therefore pressurized gas is conserved and unnecessary foam production is avoided.

In one embodiment, the control unit can include a transceiver 68 allowing communications with a remote server 76, portable compute device 78 (e.g. smart phone, iPhone, and the like) or other controllers. The controller can transmit and receive information from the remote computer or smart phone. For example, a user can access the smartphone, or more specifically an app on the smart phone, and review information such as the beer that is current in the growler, the environmental conditions, the amount of beer left in the growler and the time the beer has been stored. Such information can be used to determine whether the user should stop and retrieve additional growlers or whether there is a sufficient quantity of beer in the housing.

The control unit can be in communications with the remote server and transmit environmental information and other information to a central database 80. The data stored on the database can be aggregated for market analysis to determine information such as most popular beer purchased for a given region, average length of storage time, temperature, average pour time, and much more information. By combining this information with demographic information, valuable market analysis can be performed and access by distillers 82 and retailers 84 and others through as remote location by with electronic communications to the remote server.

In one embodiment, a growler identification reader 101 can be included and in communications with the controller that can read identifying information from the growler. For example, the reader can read a barcode, label, text, graphics, or some combination. The information on the growler can be associated with the time the growler was placed on the housing, content information, such as flavor, brand name, origin, purchase location, and the like. In one embodiment, when information about the fluid in a beverage container it entered, the control unit can transmit a request for additional information to a server. The server can access external databases and retrieve additional beverage information that can be transmitted to the control unit. Such additional information can include purchase information, alcohol content, brewery information, and the like.

Figure 5:
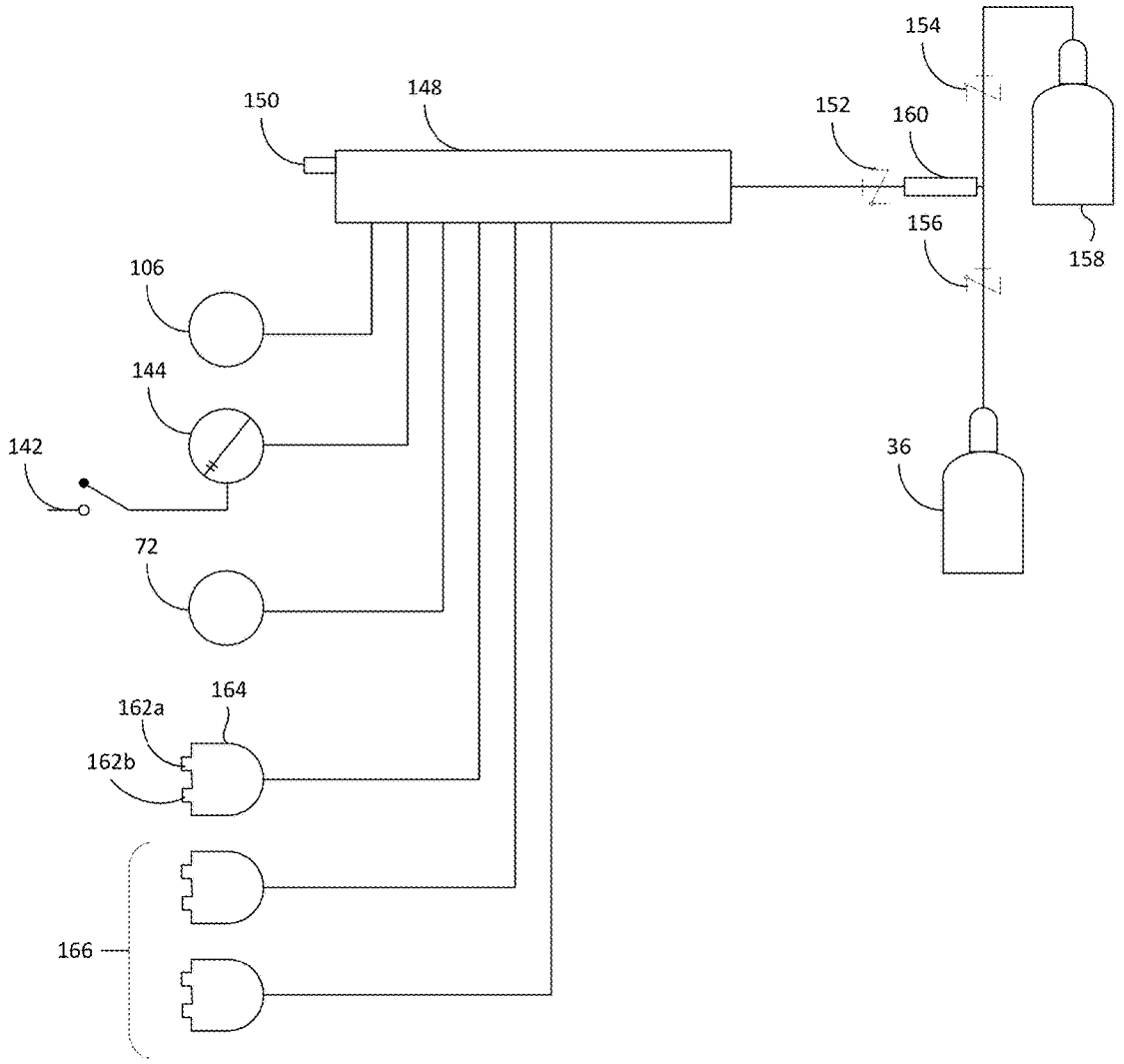
FIG. 5 shows schematic of aspects of the invention.

Referring to FIG. 5, a gas manifold 148 can be carried by the housing and be in fluid communications with the pressurized gas container 36. A check valve 156 can prevent pressurized gas or other fluid from back flowing into the pressurized gas container. In one embodiment, check valve 156 can be closed to remove the fluid communication between the manifold and the pressurized gas container. The manifold can be in fluid communication from an external or alternative gas source 158. A check valve 154 can prevent pressurized gas or other fluid from back flowing into the external or alternative gas container. In one embodiment, check valve 154 can be closed to remove the fluid communication between the manifold and the pressurized gas container. A gas regulator 160 can be disposed between the pressurized gas container and/or the external or alternative gas source and the manifold to control the amount of pressure delivered to the manifold from the pressurized gas container. The manifold can include a safety valve 150 that can open when excess pressure occurs in the manifold. The manifold can be connected to a pressure gauge 106 to display the pressure in the manifold. The manifold can be connected to the purge assembly. A purge valve can be disposed between the manifold and the purge assembly to allow and prevent the flow of gas between the manifold and the purge assembly. The purge valve can be connected to the control unit and actuated by the control unit using switch or solenoid 142. The manifold can be attached to pressure sensor 72 which can also be connected to the control unit to provide pressure information to the control unit. The manifold can be attached to a first, second, and/or third dispensing connector assembly that can be connected to a removable cap allowing pressure to be delivered to the beverage container when the tap is opened. In one embodiment, the regulator maintains a predetermined pressure level from the manifold the various components attached to the manifold. In one embodiment, the manifold is in fluid communication with one or more connectors such as 162*a* and 162*b*. The connectors can allow fluid to flow from the beverage container through a line to the tap. Another connector can allow pressurized gas to be injected into the beverage container. The connectors can be attached to a beverage connector block 164. Multiple connectors and beverage connector blocks 166 can be in fluid communication with the manifold.

Figure 6:
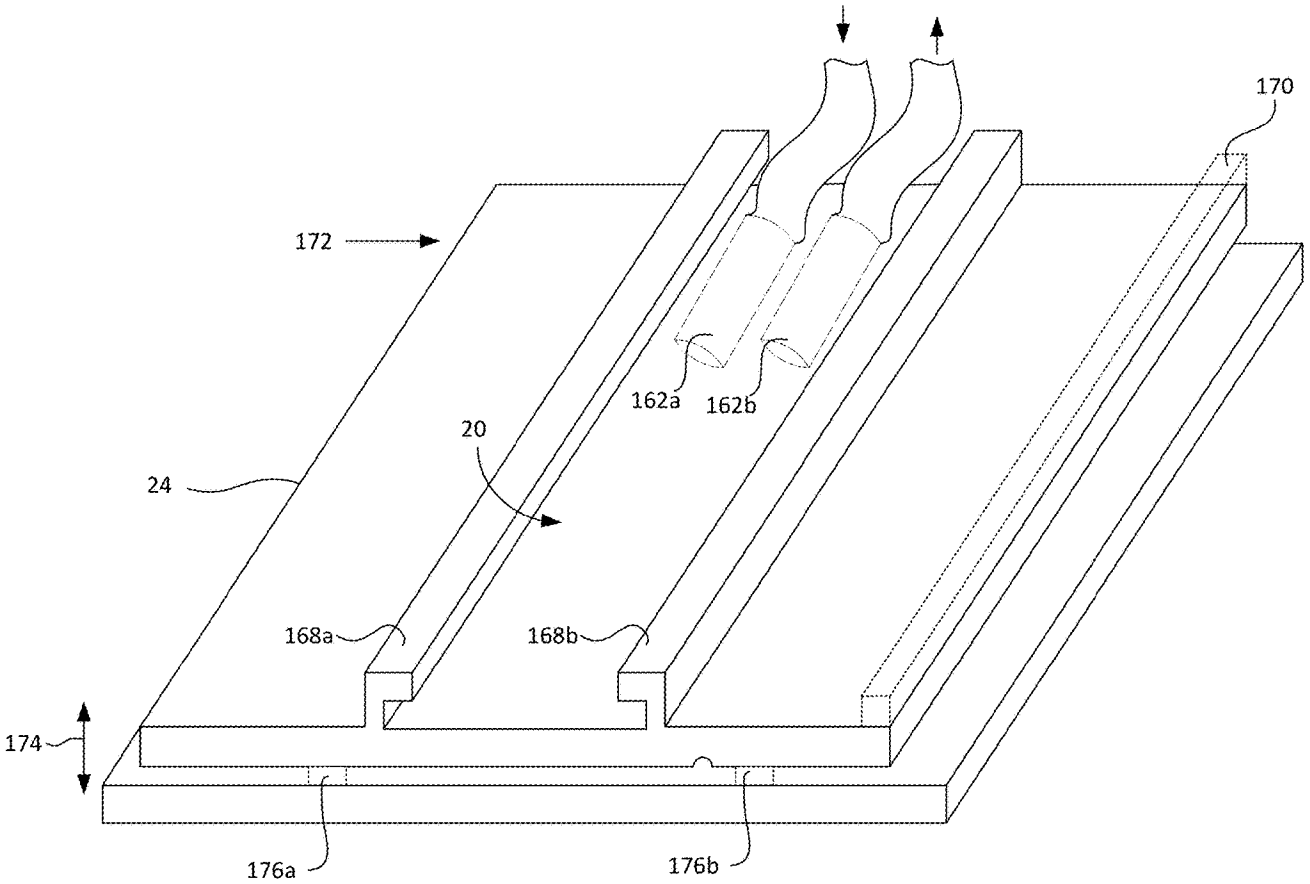
FIG. 6 shown a perceptive view of aspects of the present invention.

Referring to FIG. 6, the tray that can support the removable cap and beverage container while the beverage container is in fluid communications with the tap is show. Tray 24 is shown having a slot 20 that can receive the removable cap. Connectors 162*a* and 162*b* can carried by the housing and arranged with the tray so that when the removable beverage cap is placed on the tray in the slot, the beverage cap aligns and connects to the connectors to provide for fluid communications between the fluid and the tap and the beverage container and the pressurized gas. The tray can include lateral ridges 168*a* and 168*b* to define the slot 20. The slot can also be defined by a recess in the tray. In one embodiment, the tray can include lateral side walls such as shown dotted as 170. The tray can be disposed in the housing to include a pivot point 172 allowing the proximal end of the tray to travel along a general path shown as 174. When the beverage container is full, there is more force applied downward on the tray that can be measured with weight sensors such as shown as 176*a* and 176*b*. The sensors can be connected to the control unit and can include a quick release level allowing the connectors to be easily connected to and released from the removable cap.

In one embodiment, the control unit includes a storage medium and a set of computer readable instructions. The computer readable instructions provide for receiving beverage container information from an input assembly, such as a touch screen or remote computer device, receiving weight information from the scale, approximating the volume of fluid remaining in the container according to the beverage container information weight information, receiving the temperature from the temperature sensor, activating the refrigeration assembly when the temperature exceeds a pre-set temperature and deactivating the refrigeration assembly when the temperature fall below the pre-set temperature, receiving pressure information from the pressure sensor, displaying at least a portion of the beverage container information, approximate fluid remaining in the beverage container and temperature on the display, accessing an external database, retrieving additional beverage container information and displaying at least a portion of the additional beverage container information on the display, receiving purchase information from an external server and displaying purchase information on the display. A transceiver included in the control unit or in communications with the control unit for transmitting the approximate fluid remaining in the beverage container, temperature in the air-conditioned compartment, pressure of the pressurized gas container, purchase information, at least a portion of the beverage container information and additional beverage container information to the remote computer device and transmitting the beverage container information and approximate fluid remaining in the beverage container to an aggregation database.

While the present subject matter has been described in detail with respect to specific exemplary embodiments and methods thereof, it will be appreciated that those skilled in the art, upon attaining an understanding of the foregoing may readily produce alterations to, variations of, and equivalents to such embodiments. Accordingly, the scope of the present disclosure is by way of example rather than by way of limitation, and the subject disclosure does not preclude inclusion of such modifications, variations and/or additions to the present subject matter as would be readily apparent to one of ordinary skill in the art using the teachings disclosed herein.

What is claimed is:

1. A dispensing unit for beverages comprising:

a housing having an air-conditioned compartment and a utility compartment;

a refrigeration assembly disposed in the utility compartment accessible through a utility compartment door for cooling the air-conditioned compartment;

a pressurized gas container removably disposed in the utility compartment and removably connected to a manifold to delivery pressured gas to the manifold;

a gas regulator disposed between the pressurized gas container and the manifold to control the pressure of gas delivered to the manifold;

a one-way valve in fluid communications with the manifold to prevent fluid from back flowing from the manifold;

a purge assembly carried by the housing and in fluid communication with the manifold;

a removable cap removably attached to the purge assembly and removably attached to a beverage container, the removable cap having an inlet and an outlet;

a purge actuator included in the purge assembly that, when actuated, opens a purge valve disposed between the manifold and the removable cap so that a predetermined amount of pressurized gas enters the beverage container so that pressurized gas from the purge assembly can be injected into the container to displace the existing gas in the headspace of the beverage container;

a tray disposed in the air-conditioned compartment having a connection block removably connected to the removable cap and in fluid communications with the manifold so that the contents of the beverage container are pressurized;

a tap attached to the housing and in fluid communications with the fluid in the beverage container so that when the tap is actuated, fluid in the beverage container is dispensed through the tap;

a control unit carried by the housing connected to a display;

a scale carried by the tray and connected to the control unit to determine the weight of the beverage container plus the fluid in the beverage container;

a temperature sensor disposed in the air-conditioned compartment and connected to the control unit to determine the temperature in the air-conditioned compartment;

a pressure sensor in fluid communication with the manifold for determining the pressure in the pressurized gas container and in communications with the control unit;

a set of computer readable instructions included in the control unit for receiving beverage container information from an input assembly carried by the housing and connected to the control unit, receiving weight information from the scale, approximating the volume of fluid remaining in the container according to the beverage container information weight information, receiving the temperature from the temperature sensor, activating the refrigeration assembly when the temperature exceeds a pre-set temperature and deactivating the refrigeration assembly when the temperature fall below the pre-set temperature, receiving pressure information from the pressure sensor, displaying at least a portion of the beverage container information, approximate fluid remaining in the beverage container and temperature on the display, accessing an external database, retrieving additional beverage container information and displaying at least a portion of the additional beverage container information on the display, receiving purchase information from an external server and displaying purchase information on the display; and, a transceiver included in the control unit for transmitting the approximate fluid remaining in the beverage container, temperature in the air-conditioned compartment, pressure of the pressurized gas container, purchase information, at least a portion of the beverage container information and additional beverage container information to the remote computer device and transmitting the beverage container information and approximate fluid remaining in the beverage container to an aggregation database.

2. The dispensing unit of claim 1 including an external pressurized gas connection so that an external source of pressurized gas can be attached to the manifold.

3. The dispensing unit of claim 1 wherein the inlet and the outlet of the removable cap include quick connects that are released by a purge release lever included in the purge assembly to release the removable cap from the purge assembly and are released by a connection block release lever carried by the connection block to release the removable cap from the connection block.

4. The dispensing unit of claim 1 including a short snorkel attached to the removable cap so that when the beverage container is inverted when disposed in the air-conditioned compartment so that the amount of sediment being dispensed is reduced.

5. The dispensing unit of claim 1 including a purge snorkel attached to the removable cap so that pressurized gas from the pressurized gas container enters the beverage container through the removable cap so that pressurized gas from the purge assembly is deposited in the bottom half of the beverage container.

6. The dispensing unit of claim 1 including a slot included in the container tray for receiving the removable cap when the inverted container is placed on the container tray.

7. The dispensing unit of claim 1 including a second removable cap removable attached to a second beverage container and in fluid communications with the manifold so that pressurized gas can enter the second beverage container forcing fluid from the second beverage container through a second tap so that fluid from the second container disposed on the air-conditional compartment can be dispensed externally from the housing.

8. The dispensing unit of claim 1 wherein the set of computer readable instructions include instructions for transmitting warnings to the remote computer device when the approximate fluid remaining in the beverage container falls below a pre-determined amount.

9. A dispensing unit for beverages comprising:

a housing;

a refrigeration assembly carried by the housing for cooling a compartment defined in the housing;

a pressurized gas container removably connected to a gas manifold to delivery pressured gas to the manifold;

a purge assembly carried by the housing and in fluid communication with the pressurized gas container;

a removable cap removably attached to the purge assembly and removably attached to a beverage container, the removable cap;

a purge actuator included in the purge assembly that, when actuated, injects pressurized gas from the pressurized gas container into the beverage container through the removable cap so that pressurized gas from the purge assembly can be injected into the container to displace the existing gas in the headspace;

a tap attached to the housing and in fluid communications with the fluid in the beverage container so that when the tap is actuated, fluid in the beverage container is dispensed through the tap;

a scale carried by the housing to measure the weight of the beverage container and the fluid in the beverage container;

a control unit attached to the scale for approximating the volume of fluid in the container according to the weight of the container and the fluid in the beverage container; and, a display connected to the control unit and carried by the housing for displaying the approximate volume of fluid in the beverage container.

10. The beverage unit of claim 9 including a transceiver included in the control unit for transmitting the approximate volume of fluid to a remote computer device.

11. The dispensing unit of claim 9 including a second removable cap removable attached to a second beverage container and in fluid communications with the pressurized gas container forcing fluid from the second beverage container through a second tap so that fluid from the second container can be dispensed externally from the housing.

12. The dispensing unit of claim 9 including an air-conditioned compartment for receiving the beverage container within the housing through an air-conditioned compartment door.

13. The dispensing unit of claim 12 including:

a temperature sensor disposed in the air-conditioning compartment, connected to a control unit carried by the housing for measuring the temperature in the air-conditioned compartment; and' wherein the control unit receives the temperature from the temperature sensor to the control unit so that the control unit can display the temperature on a display carried by the housing and connected to the control unit.

14. The dispensing unit of claim 9 including a set of computer readable instructions included in a control unit carried by the housing approximating the volume of fluid remaining in the container according to the beverage container information weight information received from a scale disposed in the housing, receiving the temperature from the temperature sensor disposed in the housing, receiving beverage container information and displaying the approximate volume of fluid remaining, at least a portion of the additional container information and temperature on a display connected to the control unit.

15. A dispensing unit for beverages comprising:

a housing having a refrigeration assembly for air-conditioning an internal compartment defined in the housing;

a pressurized gas source, selected from the group of a pressurized gas, external pressurized gas source, or a combination of both;

a purge assembly carried by the housing and in fluid communication with the pressurized gas source;

a removable cap removably attached to the purge assembly and removably attached to a beverage container so that pressurized gas enters the beverage container to displace the existing gas in the headspace when the removable cap is attached to the purge assembly;

a tap attached to the housing so that fluid in the beverage container is dispensed through the tap when the removable cap is in fluid communication with the tap and the tap is actuated;

a pressure sensor in fluid communication with the pressurized gas source for determining the pressure in the pressurized gas source;

a control unit carried by the housing and connected to the pressure sensor;

a set of computer readable instruction included in the control unit for receiving the pressure in the pressurized gas source, displaying the pressure in the pressurized gas source on a display connected to the control unit;

transmitting the pressure in the pressurized gas source to an external server in communications with the control unit;

receiving ordering information for a replacement pressurized gas container from the external server; and, displaying the ordering information on the display.

16. The dispensing unit of claim 15 including:

a tray supporting the beverage container and removable cap when the removable cap is in fluid communication with the tap;

a scale carried by the tray to determine the weight of the beverage container plus the fluid in the beverage container;

a control unit carried by the housing and connected to the scale;

a set of computer readable instruction included in the control unit for receiving the weight of the beverage container plus the fluid in the beverage container, receiving beverage container information and approximating the volume of fluid remaining in the beverage container according to the weight and beverage container information and displaying the approximate volume of fluid remaining in the beverage container on a display connected to the control unit.

17. The dispensing unit of claim 15 wherein the set of computer readable instructions included instructions for transmitting the approximate volume of fluid remaining in the beverage container to a remote computer device in communication with the control unit.

18. The dispensing unit of claim 15 wherein:

the pressurized gas container has a volume in the range of 70 grams to 120 grams; and, the beverage container is a growler with a volume in the range of 25 ounces to 80 ounces.

* * * * *